US010036343B2

(12) United States Patent
Mitsuda

(10) Patent No.: US 10,036,343 B2
(45) Date of Patent: Jul. 31, 2018

(54) CONTROL APPARATUS

(71) Applicant: DENSO CORPORATION, Kariaya, Aichi-pref. (JP)

(72) Inventor: Tetsuji Mitsuda, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/542,241

(22) PCT Filed: Feb. 22, 2016

(86) PCT No.: PCT/JP2016/000913
§ 371 (c)(1),
(2) Date: Jul. 7, 2017

(87) PCT Pub. No.: WO2016/157700
PCT Pub. Date: Oct. 6, 2016

(65) Prior Publication Data

US 2018/0003123 A1 Jan. 4, 2018

(30) Foreign Application Priority Data

Mar. 27, 2015 (JP) ..... 2015-67457

(51) Int. Cl.
*F02D 41/30* (2006.01)
*F02D 41/14* (2006.01)

(52) U.S. Cl.
CPC ..... *F02D 41/3029* (2013.01); *F02D 41/146* (2013.01); *F02D 41/1447* (2013.01); *F02D 41/1448* (2013.01); *F02D 41/1454* (2013.01)

(58) Field of Classification Search
CPC ..... B60W 2510/0619; F02B 19/1052; F02B 1/12; F02B 7/00; F02B 2075/125;
(Continued)

(56) References Cited

U.S. PATENT DOCUMENTS

2007/0240695 A1* 10/2007 Mitsuda ..... F02D 13/06 123/673
2008/0178656 A1* 7/2008 Nieuwstadt ..... G01M 15/102 73/23.31

(Continued)

FOREIGN PATENT DOCUMENTS

JP 2002-54492 2/2002

*Primary Examiner* — John Kwon
(74) *Attorney, Agent, or Firm* — Nixon & Vanderhye PC

(57) ABSTRACT

A control apparatus of an internal combustion engine having an injector which directly injects fuel into a combustion chamber of a cylinder and a spark plug which ignites an air-fuel mixture containing the fuel injected by the injector includes an air-fuel ratio acquisition unit acquiring an air-fuel ratio of the air-fuel mixture in the combustion chamber, a nitrogen oxide concentration acquisition unit acquiring a concentration of nitrogen oxide in a combustion gas exhausted from the internal combustion engine, and a stratification level estimation unit estimating a level of stratification as a measure of level of distribution of the air-fuel mixture at a predetermined air-fuel ratio or below in a vicinity of the spark plug. The stratification level estimation unit estimates the level of stratification according to the air-fuel ratio acquired by the air-fuel ratio acquisition unit and the concentration of nitrogen oxide acquired by the nitrogen oxide concentration acquisition unit.

4 Claims, 6 Drawing Sheets

(58) Field of Classification Search
CPC .. F02B 23/101; F02D 41/34; F02D 2041/389; F02D 41/0025
USPC ..... 701/103–105; 123/294, 295, 305, 434
See application file for complete search history.

(56) References Cited

U.S. PATENT DOCUMENTS

2010/0312445 A1* 12/2010 Bogema ..... F01N 3/208 701/70
2013/0180498 A1* 7/2013 Rabhi ..... F02B 17/005 123/295
2013/0199494 A1* 8/2013 Rabhi ..... F02B 17/005 123/295
2016/0258345 A1* 9/2016 Kimura ..... F02D 41/402
2016/0298586 A1* 10/2016 Kimura ..... F02M 59/22

* cited by examiner

CONTROL APPARATUS

CROSS REFERENCE TO RELATED APPLICATION

This application is the U.S. national phase of International Application No. PCT/JP2016/000913 filed Feb. 22, 2016 which designated the U.S. and claims priority to Japanese Patent Application No. 2015-67457 filed on Mar. 27, 2015, the entire contents of each of which are incorporated herein by reference.

TECHNICAL FIELD

The present disclosure relates to a control apparatus of an internal combustion engine having an injector which directly injects fuel into a combustion chamber of a cylinder, and a spark plug which ignites an air-fuel mixture containing fuel injected by the injector.

BACKGROUND ART

Combustion control for an internal combustion engine is becoming more sophisticated and complex in recent years. For example, an internal combustion engine in widespread use burns an air-fuel mixture in a lean-burn state in a combustion chamber of a cylinder. Fuel efficiency of the internal combustion engine can be improved by maintaining fuel combustion in the lean-burn state.

Stratified charge combustion is one type of combustion in the lean-burn state. Stratified charge combustion is to ignite and burn an air-fuel mixture in a state where a rich air-fuel mixture is distributed in a vicinity of a spark plug while a lean air-fuel mixture is distributed on a periphery of the rich air-fuel mixture. When the air-fuel mixture is distributed as above, an air-fuel ratio in the entire combustion chamber is too lean for the air-fuel mixture to burn but sufficiently rich in the vicinity of the spark plug. While a contribution can be made to improvement of fuel efficiency, stratified charge combustion has a problem that a nitrogen oxide and a black exhaust are readily produced when an air-fuel mixture is burned while being distributed inappropriately.

In order to solve the problem as above, Patent Literature 1 describes a control apparatus which estimates a level of stratified charge combustion representing a distribution tendency of an air-fuel mixture at a combustible air-fuel ratio in the combustion chamber. The control apparatus detects an air-fuel ratio from a combustion gas exhausted from the internal combustion engine during stratified charge combustion and also estimates a level of stratified charge combustion according to a waveform of the detected air-fuel ratio. In addition, the control apparatus adjusts fuel injection timing according to the estimated level of stratified charge combustion and controls the internal combustion engine to maintain an appropriate level of stratified charge combustion.

PRIOR ART LITERATURES

Patent Literature

Patent Literature 1; JP2002-54492A

SUMMARY OF INVENTION

The control apparatus described in Patent Literature 1, however, achieves only a low degree of accuracy in estimating a distribution of the air-fuel mixture in the combustion chamber. Hence, the control apparatus may fail to maintain an appropriate distribution, in which case a larger amount of nitrogen oxide or the like may possibly be produced by the stratified charge combustion.

An object of the present disclosure is to provide a control apparatus capable of estimating a level of stratification as a measure of level of distribution of an air-fuel mixture at or below a predetermined air-fuel ratio in a vicinity of a spark plug with a high degree of accuracy.

According to an aspect of the present disclosure, the control apparatus of an internal combustion engine having an injector which directly injects fuel into a combustion chamber of a cylinder and a spark plug which ignites an air-fuel mixture containing the fuel injected by the injector includes an air-fuel ratio acquisition unit, a nitrogen oxide concentration acquisition unit, and a stratification level estimation unit. The air-fuel ratio acquisition unit acquires an air-fuel ratio of the air-fuel mixture in the combustion chamber. The nitrogen oxide concentration acquisition unit acquires a concentration of nitrogen oxide in a combustion gas exhausted from the internal combustion engine. The stratification level estimation unit estimates a level of stratification as a measure of level of distribution of the air-fuel mixture at a predetermined air-fuel ratio or below in a vicinity of the spark plug. The stratification level estimation unit estimates the level of stratification according to the air-fuel ratio acquired by the air-fuel ratio acquisition unit and the concentration of nitrogen oxide acquired by the nitrogen oxide concentration acquisition unit.

According to the present disclosure, the control apparatus estimates a level of stratification according to not only an air-fuel ratio of an air-fuel mixture in the combustion chamber, but also a concentration of nitrogen oxide in a combustion gas exhausted from the engine. That is, given a circumstance that a concentration of nitrogen oxide in a combustion gas may possibly be increased as an outcome of the stratified charge combustion, the control apparatus estimates a level of stratification also according to the concentration of nitrogen oxide in the combustion gas. Hence, according to the present disclosure, a level of stratification can be estimated with a high degree of accuracy.

According to the present disclosure, the control apparatus capable of estimating a level of stratification as a measure of level of distribution of an air-fuel mixture at or below a predetermined air-fuel ratio in a vicinity of a spark plug with a high degree of accuracy can be provided.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Figure 1:
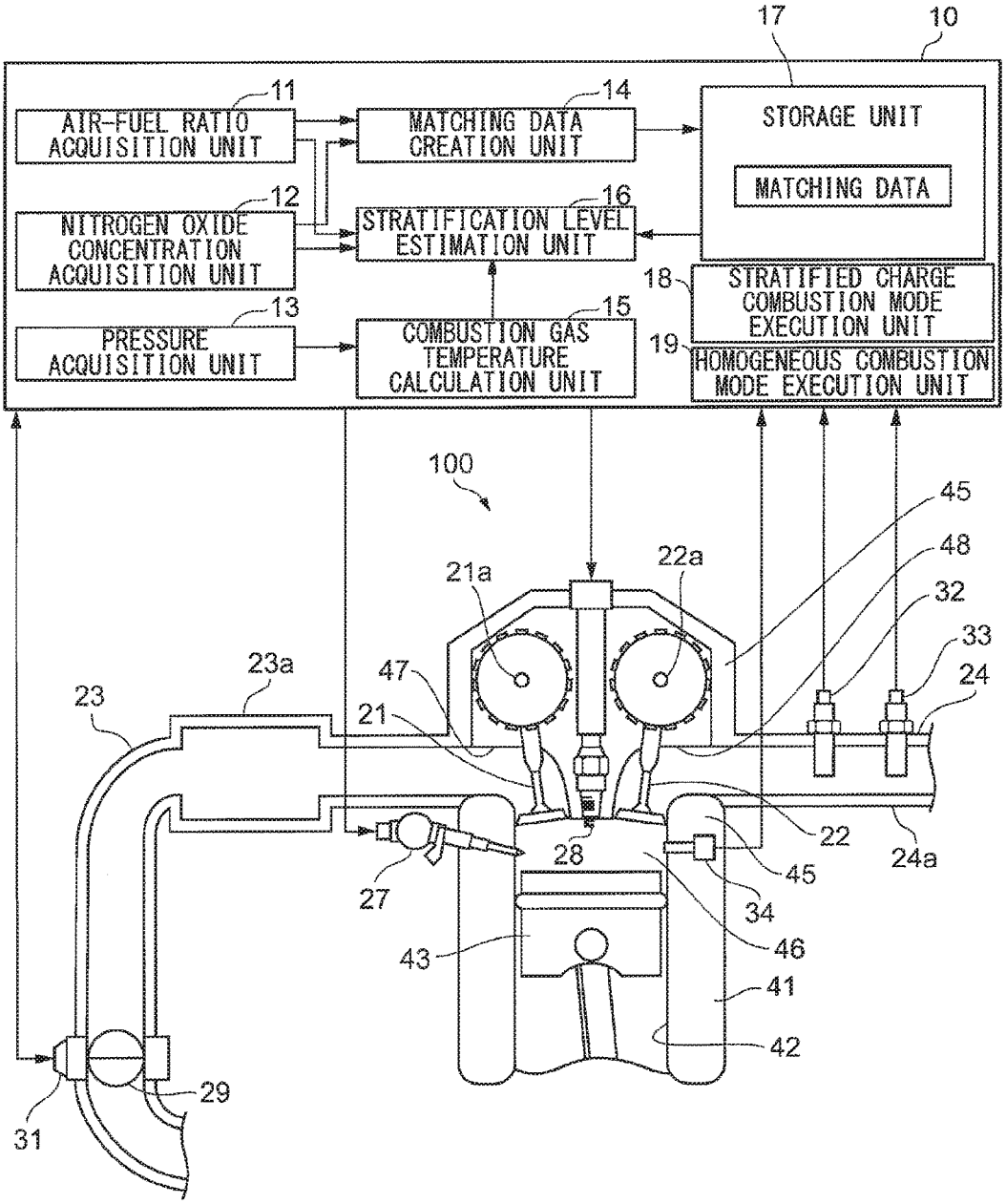
FIG. 1 is a schematic view of an ECU according to an embodiment of the present disclosure and an engine as a controlled subject.

Embodiments of the present disclosure will be described hereafter referring to drawings. In the embodiments, a part that corresponds to a matter described in a preceding embodiment may be assigned with the same reference numeral, and redundant explanation for the part may be omitted.

An ECU 10 according to an embodiment of the present disclosure will be described with reference to FIG. 1. The ECU 10 controls an in-cylinder injection engine (internal combustion engine) 100 installed to an unillustrated vehicle. A schematic configuration of the engine 100 will be described first.

The engine 100 has a cylinder block 41 that is made of a cast-iron material. A cylinder 42 that is a tubular shape is provided inside the cylinder block 41. The engine 100 is intended to represent a mufti-cylinder spark-ignition reciprocating engine and only one cylinder 42 is shown in FIG. 1 for ease of description.

A piston 43 is housed in the cylinder 42. The piston 43 is allowed to reciprocate in the cylinder 42. An unillustrated crankshaft functioning as an output shaft is configured to rotate with reciprocal motion of the piston 43 in the cylinder 42.

A cylinder head 45 is fixed to an upper end face of the cylinder block 41. A combustion chamber 46 is defined between the cylinder head 45 and an upper surface of the piston 43.

The cylinder head 45 is provided with an intake port 47 and an exhaust port 48 both opening in the combustion chamber 46. The intake port 47 and the exhaust port 48 are configured to be opened and closed, respectively, by an intake valve 21 and an exhaust valve 22 driven, respectively, by cams 21*a* and 22*a*.

An unillustrated variable valve timing mechanism is attached to each of the intake valve 21 and the exhaust valve 22 to make opening and closing timing of each valve adjustable.

An intake tube 23 is connected to the intake port 47. The intake tube 23 introduces air let in from outside the vehicle to the intake port 47 of the engine 100. Also, an exhaust tube 24 is connected to the exhaust port 48. The exhaust tube 24 introduces a combustion gas exhausted from each cylinder 42 to an outside of the vehicle.

The intake tube 23 is provided with a throttle valve 29 and a throttle opening degree sensor 31. The throttle valve 29 is an electronically controlled ON-OFF valve, an opening degree of which is adjusted by an actuator, such as a DC motor. By changing an opening degree of the throttle valve 29, a flow rate of air introduced to the intake port 47 can be regulated. The throttle opening degree sensor 31 detects an opening degree and motion (variance in opening degree) of the throttle valve 29. The throttle opening degree sensor 31 is electrically connected to the ECU 10 and sends a signal corresponding to a detection value to the ECU 10. The phrase, "being electrically connected", referred to in the present disclosure is not limited to a state in which a connection is established by cable and also includes a state in which two-way communications are enabled by radio.

A surge tank 23*a* is provided to the intake tube 23 situated downstream of the throttle valve 29. A passage area of the surge tank 23*a* is increased in comparison with the intake tube 23 installed before and after the surge tank 23*a*. By providing the surge tank 23*a* to the intake tube 23, intake pulsation and intake interference can be prevented.

A collector unit 24*a* of the exhaust tube 24, which is a unit where a combustion gas exhausted from each cylinder 42 is collected, is provided with an air-fuel ratio sensor 32 and a NOx sensor 33. The air-fuel ratio sensor 32 is a device which detects a concentration of oxygen in a combustion gas flowing the exhaust tube 24. The NOx sensor 33 is a device which detects a concentration of nitrogen oxide in the combustion gas flowing the exhaust tube 24. Each of the air-fuel ratio sensor 32 and the NOx sensor 33 sends a signal corresponding to a detection value to the ECU 10.

An injector 27 is attached to the combustion chamber 46 in the cylinder 42. The injector 27 is an electromagnetically driven actuator which supplies fuel, that is, gasoline, into the combustion chamber 46 by direct injection. FIG. 1 shows the injector 27 provided inside one cylinder 42 alone for ease of description. However, the injector 27 configured as above is provided to each cylinder 42.

A cylinder internal pressure sensor 34 and a spark plug 28 are also attached to the combustion chamber 46. The cylinder internal pressure sensor 34 is a device which detects an internal pressure of the combustion chamber 46. The spark plug 28 is a device which ignites an air-fuel mixture when a high voltage is applied at predetermined ignition timing according to an instruction from the ECU 10.

In an induction stroke of the engine 100 configured as above, the intake valve 21 is opened and an internal pressure of the combustion chamber 46 falls as the piston 43 moves down to let air into the combustion chamber 46 through the intake tube 23. When air is let in, fuel is injected into the combustion chamber 46 from the injector 27. Injected fuel is mixed with air let into the combustion chamber 46 and forms an air-fuel mixture.

In a compression stroke of the engine 100, the intake valve 21 is closed and the air-fuel mixture is compressed as the piston 43 moves up. When the air-fuel mixture is compressed, fuel is injected into the combustion chamber 46 from the injector 27. An amount of fuel injected from the injector 27 in the compression stroke is smaller than an amount of fuel injected in the induction stroke. The air-fuel mixture is ignited by the spark plug 28 and burns in a combustion stroke of the engine 100. A combustion gas produced by combustion of the air-fuel mixture is exhausted to the exhaust tube 24 from the combustion chamber 46 as the exhaust valve 22 is opened in an exhaust stroke of the engine 100.

The ECU 10 will now be described. The ECU 10 is partially or entirely formed of an analog circuit or formed as a digital processor. In either case, a functional control block is formed in the ECU 10 because the ECU 10 functions to output a control signal according to a received signal.

FIG. 1 shows the ECU 10 in a functional control block diagram. An analog circuit or a module of software installed to a digital processor, whichever forms the ECU 10, is not necessarily divided to control blocks shown in FIG. 1. The analog circuit or the module of software in a single body may operate as multiple control blocks or may be divided further to a larger number of control blocks. Anyone skilled in the art may change an actual internal configuration of the ECU 10 as needed as long as the ECU 10 is configured to perform processing.

The ECU 10 is electrically connected to various sensors, such as the throttle opening degree sensor 31, various actuators, such as the injector 27. The ECU 10 has an air-fuel ratio acquisition unit 11, a nitrogen oxide concentration acquisition unit 12, a pressure acquisition unit 13, a matching data creation unit 14, a combustion gas temperature calculation unit 15, a stratification level estimation unit 16, a storage unit 17, a stratified charge combustion mode execution unit 18, and a homogeneous combustion mode execution unit 19.

The air-fuel ratio acquisition unit 11 is a unit which acquires an air-fuel ratio of an air-fuel mixture in the combustion chamber 46 by performing a predetermined computation using a signal received from the air-fuel ratio sensor 32. More specifically, the air-fuel ratio acquisition unit 11 acquires an air-fuel ratio of an air-fuel mixture in the combustion chamber 46 according to a concentration of oxygen in a combustion gas produced by combustion in the combustion chamber 46. The nitrogen oxide concentration acquisition unit 12 acquires a concentration of nitrogen oxide in a combustion gas flowing the exhaust tube 24 by performing a predetermined computation using a signal received from the NOx sensor 33. The pressure acquisition unit 13 acquires an internal pressure of the combustion chamber 46 by performing a predetermined computation using a signal received from the cylinder internal pressure sensor 34.

The matching data creation unit 14 is a unit which creates matching data according to an air-fuel ratio of an air-fuel mixture in the combustion chamber 46 acquired by the air-fuel ratio acquisition unit 11 and a concentration of nitrogen oxide in a combustion gas acquired by the nitrogen oxide concentration acquisition unit 12. The combustion gas temperature calculation unit 15 is a unit which calculates a temperature of a combustion gas in the combustion chamber 46 according to an internal pressure of the combustion chamber 46 acquired by the pressure acquisition unit 13. The stratification level estimation unit 16 is a unit which estimates a level of stratification of an air-fuel mixture in the combustion chamber 46 according to an air-fuel ratio of an air-fuel mixture in the combustion chamber 46 acquired by the air-fuel ratio acquisition unit 11, a concentration of nitrogen oxide in a combustion gas acquired by the nitrogen oxide concentration acquisition unit 12, and a temperature of a combustion gas in the combustion chamber 46 calculated by the combustion gas temperature calculation unit 15. The storage unit 17 is a unit in which data, such as the matching data created by the matching data creation unit 14, is stored.

The stratified charge combustion mode execution unit 18 is a unit which executes a stratified charge combustion mode, which is one type of combustion of an air-fuel mixture in the combustion chamber 46. In the stratified charge combustion mode, an air-fuel mixture is burned while a level of stratification of an air-fuel mixture in the combustion chamber 46 is at or above a threshold. More specifically, the stratified charge combustion mode execution unit 18 provides a state in which a level of stratification of an air-fuel mixture in the combustion chamber 46 is at or above the threshold by adjusting an amount of fuel to be injected by the injector 27, injection timing, the number of injections, the internal pressure, ignition energy of the spark plug 28, ignition timing, the number of ignitions, and so on as needed, and triggers combustion of the air-fuel mixture.

The homogeneous combustion mode execution unit 19 is a unit which executes a homogeneous combustion mode, which is another type of combustion of an air-fuel mixture in the combustion chamber 46. In the homogeneous combustion mode, an air-fuel mixture is burned while a level of stratification of an air-fuel mixture in the combustion chamber 46 is below the threshold. More specifically, the homogeneous combustion mode execution unit 19 provides a state in which a level of stratification of an air-fuel mixture in the combustion chamber 46 is below the threshold by adjusting an amount of fuel to be injected by the injector 27, injection timing, the number of injections, a pressure, ignition energy of the spark plug 28, ignition timing, the number of ignitions, and so on as needed, and triggers homogeneous combustion of the air-fuel mixture.

Figure 2:
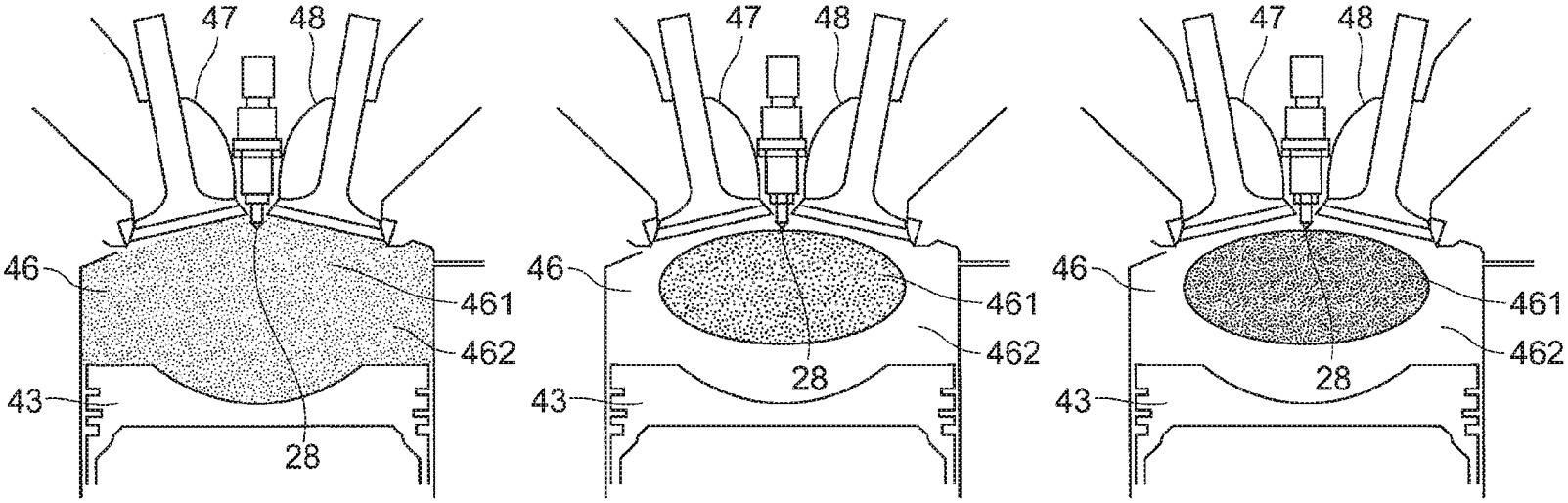
FIGS. 2(A) to 2(C) are schematic views showing distributions of an air-fuel mixture in a combustion chamber of FIG. 1.

A level of stratification of an air-fuel mixture in the combustion chamber 46, homogeneous combustion, and stratified charge combustion will now be described with reference to FIGS. 2(A) to 2(C) and FIG. 3. FIGS. 2(A) to 2(C) show three states of an air-fuel mixture in the combustion chamber 46 at different levels of stratification.

FIG. 2(A) shows a state of the combustion chamber 46 in which an air-fuel ratio of an air-fuel mixture is substantially constant. Combustion triggered by igniting an air-fuel mixture in the state specified above by the spark plug 28 is referred to as homogenous combustion.

Figure 3:
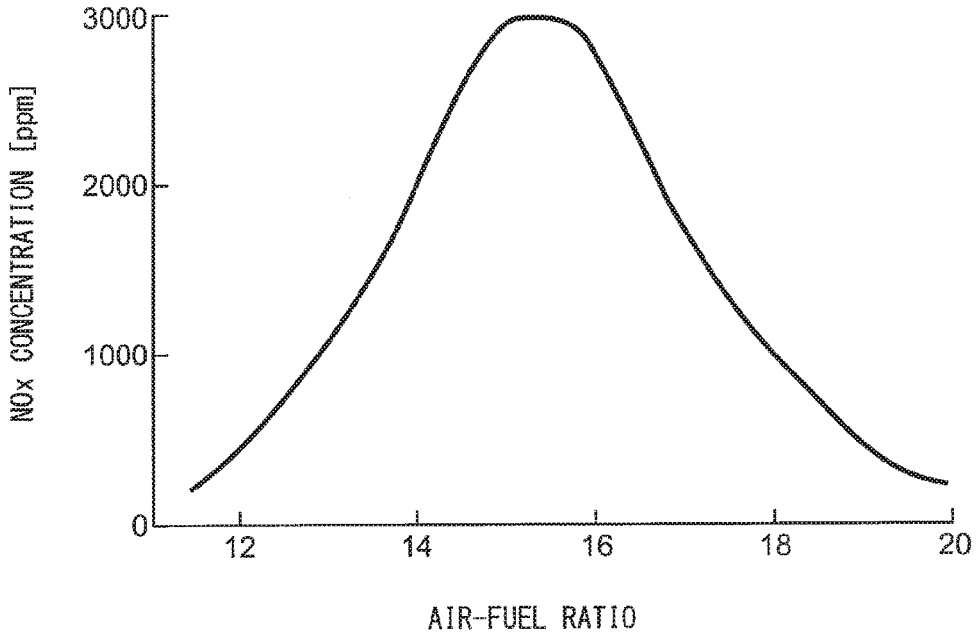
FIG. 3 is a graph showing a relation of an air-fuel ratio of an air-fuel mixture in homogeneous combustion and a concentration of nitrogen oxide in a combustion gas produced by the homogeneous combustion.

FIG. 3 is an example of a graph showing a relation of an air-fuel ratio of an air-fuel mixture in homogenous combustion and a concentration of nitrogen oxide in a combustion gas produced by homogenous combustion, which corresponds to the matching data. A concentration of nitrogen oxide in the combustion gas reaches a maximum when an air-fuel ratio of an air-fuel mixture is a stoichiometric air-fuel ratio of about 14.7. A concentration of nitrogen oxide in a combustion gas tends to decrease with an increase or a decrease of an air-fuel ratio of an air-fuel mixture from the stoichiometric air-fuel ratio.

FIG. 2(B) shows a state of the combustion chamber 46 in which an air-fuel mixture at a low air-fuel ratio is distributed in a first region 461 in a vicinity of the spark plug 28 and an air-fuel mixture at a high air-fuel ratio is distributed in a second region 462 on a periphery of the first region 461. In the state as above, an air-fuel ratio of an air-fuel mixture in the first region 461 is about 13 and an air-fuel ratio of an air-fuel mixture in the second region 462 is about 18.

FIG. 2(C) shows a state of the combustion chamber 46 in which an air-fuel mixture at a low air-fuel ratio is distributed in the first region 461 in the vicinity of the spark plug 28 and an air-fuel mixture at a high air-fuel ratio is distributed in the second region 462 on the periphery of the first region 461. In the state as above, an air-fuel ratio of an air-fuel mixture in the first region 461 is about 12 and an air-fuel ratio of an air-fuel mixture in the second region 462 is about 20.

Combustion triggered by igniting an air-fuel mixture while a rich air-fuel mixture (at a low air-fuel ratio) is distributed in the vicinity of the spark plug 28 and a lean air-fuel mixture (at a high air-fuel ratio) is distributed on the periphery of the rich air-fuel mixture as are shown in FIG. 2(B) and FIG. 2(C) is referred to as stratified charge combustion. In the present embodiment, combustion taking place while an air-fuel mixture at an air-fuel ratio of 14 or below is distributed in the first region 461 is defined as the stratified charge combustion. However, the present disclosure is not limited to the definition as above.

Also, in the present embodiment, a level of distribution of an air-fuel mixture at an air-fuel ratio of 14 or below in the vicinity of the spark plug 28 is defined as a level of stratification. In other words, a level of stratification becomes higher as an air-fuel ratio of an air-fuel mixture distributed in the vicinity of the spark plug 28 becomes lower. Also, a level of stratification becomes higher as a larger amount of an air-fuel mixture at an air-fuel ratio of 14 or below is distributed in the vicinity of the spark plug 28. Further, a level of stratification becomes higher as an air-fuel ratio of the air-fuel mixture distributed in the first region 461 becomes lower than an air-fuel ratio of the air-fuel mixture distributed in the second region 462 in the combustion chamber 46. Of the three states shown in FIGS. 2(A) to 2(C), a level of stratification becomes lowest in the state of FIG. 2(A) and a level of stratification becomes highest in the state of FIG. 2(C).

Figure 4:
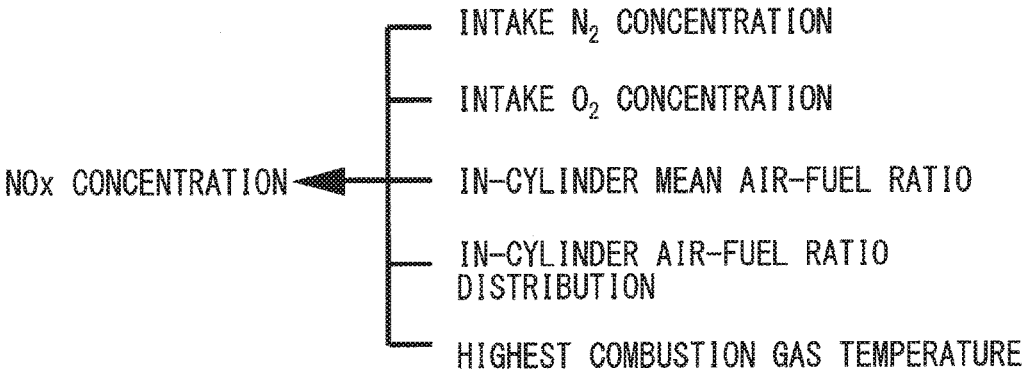
FIG. 4 is a view used to describe a concentration of nitrogen oxide acquired by a nitrogen oxide concentration acquisition unit of FIG. 1 and respective factors giving influences to the concentration of nitrogen oxide.

A relation of a concentration of nitrogen oxide acquired by the nitrogen oxide concentration acquisition unit 12 (see FIG. 1) and respective factors giving influences to the concentration of nitrogen oxide will now be described with reference to FIG. 4. As is shown in FIG. 4, a concentration of intake $N_2$, a concentration of intake $O_2$, an in-cylinder mean air-fuel ratio, an in-cylinder air-fuel ratio distribution, and a highest combustion gas temperature may possibly give influences to a concentration of nitrogen oxide acquired by the nitrogen oxide concentration acquisition unit 12.

Of the factors specified above, a concentration of intake $N_2$ and a concentration of intake $O_2$ are, respectively, a concentration of nitrogen and a concentration of oxygen in air let in from outside the vehicle. A value of each concentration may be deemed to remain substantially constant independently of environments in which the vehicle runs. The in-cylinder air-fuel ratio distribution is an air-fuel ratio of an air-fuel mixture in the combustion chamber 46 acquired by the air-fuel ratio acquisition unit 11 (see FIG. 1). The highest combustion gas temperature is a highest value of a temperature of a combustion gas in the combustion chamber 46 calculated by the combustion gas temperature calculation unit 15 (see FIG. 1). That is, values of a concentration of intake $N_2$ and a concentration of intake $O_2$ are known and the in-cylinder air-fuel distribution and the highest combustion gas temperature take values which can be acquired by the air-fuel ratio acquisition unit 11 and the combustion gas temperature calculation unit 15, respectively.

Hence, the in-cylinder air-fuel ratio distribution as remaining one factor among the factors giving influences to a concentration of nitrogen oxide serves as an index correlated to a level of stratification of an air-fuel mixture in the combustion chamber 46. In other words, a level of stratification of an air-fuel mixture in the combustion chamber 46 can be estimated by removing influences of respective factors, namely, a concentration of intake $N_2$, a concentration of intake $O_2$, an in-cylinder air-fuel ratio distribution, and a highest combustion gas temperature, from a concentration of nitrogen oxide acquired by the nitrogen oxide concentration acquisition unit 12.

Processing executed by the ECU 10 in accordance with a concept of a level of stratification as above will now be described with reference to FIG. 5 through FIG. 7. The processing is actually performed by the respective units of the ECU 10, such as the air-fuel ratio acquisition unit 11. However, the following will describe that the processing is performed by the ECU 10 for ease of description.

Figure 5:
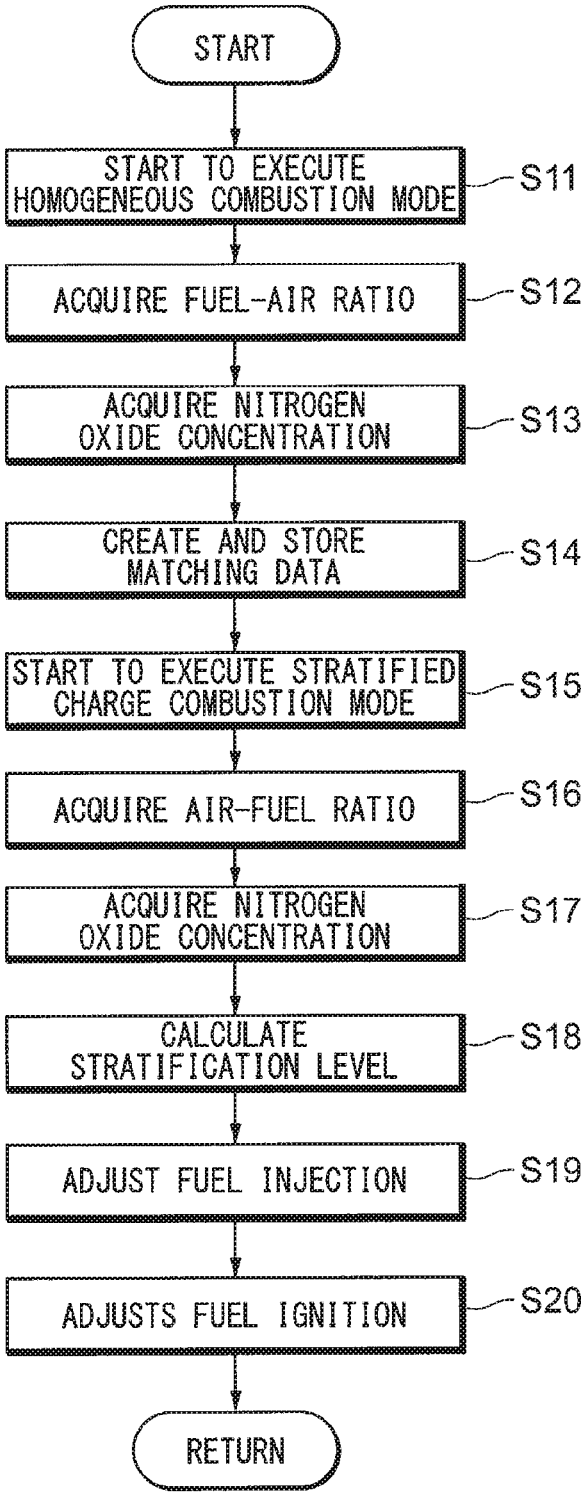
FIG. 5 is a flowchart depicting a flow of processing executed by the ECU of FIG. 1.

Firstly, the ECU 10 starts to execute the homogeneous combustion mode in S11 of FIG. 5. That is, as is shown in FIG. 2(A), homogeneous combustion of an air-fuel mixture is triggered by adjusting an amount of fuel to be injected by the injector 27, injection timing, the number of injections, a pressure, ignition energy of the spark plug 28, ignition timing, the number of ignitions, and so on to make an air-fuel ratio of an air-fuel mixture substantially constant in the combustion chamber 46.

Subsequently, the ECU 10 acquires an air-fuel ratio of an air-fuel mixture in the combustion chamber 46 in 512. The air-fuel ratio acquisition unit 11 acquires the air-fuel ratio by performing a predetermined computation using a signal received from the air-fuel ratio sensor 32 while the homogeneous combustion of the air-fuel mixture is taking place in the combustion chamber 46.

Subsequently, the ECU 10 acquires a concentration of nitrogen oxide in a combustion gas flowing the exhaust tube 24 in S13. The nitrogen oxide concentration acquisition unit 12 acquires a concentration of nitrogen oxide by performing a predetermined computation using a signal received from the NOx sensor 33 while the homogeneous combustion of the air-fuel mixture is taking place in the combustion chamber 46.

Subsequently, the ECU 10 creates the matching data and stores the created matching data into the storage unit 17 (see FIG. 1) in S14. The matching data is data graphically shown in FIG. 3 as described above and showing a relation of the air-fuel ratio of the air-fuel mixture acquired in 512 and the concentration of nitrogen oxide in the combustion gas calculated in S13. A relation of an air-fuel ratio of an air-fuel mixture and a concentration of nitrogen oxide in a combustion gas of the engine 100 varies from product to product. However, by creating the matching data according to an actual behavior of the engine 100 in S14, influences of such a variance can be eliminated.

Subsequently, the ECU 10 starts to execute the stratified charge combustion mode in S15. That is, a type of combustion of an air-fuel mixture in the combustion chamber 46 is switched from the homogenous combustion mode in execution to the stratified charge combustion mode. The stratified charge combustion mode is enabled after the matching data creation unit 14 creates the matching data. In order to distribute an air-fuel mixture in the combustion chamber 46 as is shown in FIG. 2(B) or FIG. 2(C), the ECU 10 adjusts an amount of fuel to be injected by the injector 27, injection timing, the number of injections, a pressure, ignition energy of the spark plug 28, ignition timing, the number of ignitions, and so on according to a running condition of the vehicle, and triggers combustion of fuel.

Subsequently, the ECU 10 acquires an air-fuel ratio of an air-fuel mixture in the combustion chamber 46 in S16. The air-fuel ratio acquisition unit 11 acquires an air-fuel ratio by performing a predetermined computation using a signal received from the air-fuel ratio sensor 32 while the stratified charge combustion of the air-fuel mixture is taking place in the combustion chamber 46.

Subsequently, the ECU 10 acquires a concentration of nitrogen oxide in a combustion gas flowing the exhaust tube 24 in S17. The nitrogen oxide concentration acquisition unit 12 acquires a concentration of nitrogen oxide by performing a predetermined computation using a signal received from the NOx sensor 33 while the stratified charge combustion of the air-fuel mixture is taking place in the combustion chamber 46.

Subsequently, the ECU 10 calculates a level of stratification of an air-fuel mixture in the combustion chamber 46 in S18. A level of stratification is calculated according to the air-fuel ratio of the air-fuel mixture in the combustion chamber 46 acquired in S16 and the concentration of nitrogen oxide in the combustion gas flowing the exhaust tube 24 acquired in S17.

A calculation method of a level of stratification of an air-fuel mixture in S18 will now be described in detail with reference to FIG. 6 and FIG. 7.

Figure 6:
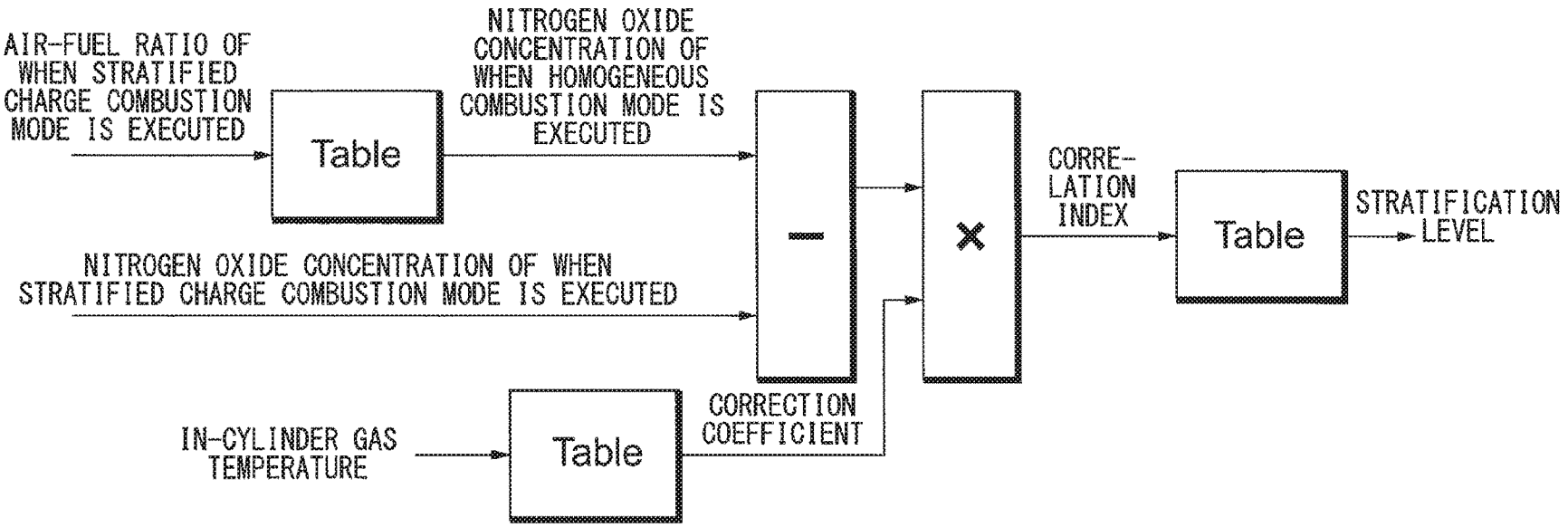
FIG. 6 is a view used to describe a calculation method of a level of stratification of an air-fuel mixture.
Figure 7:
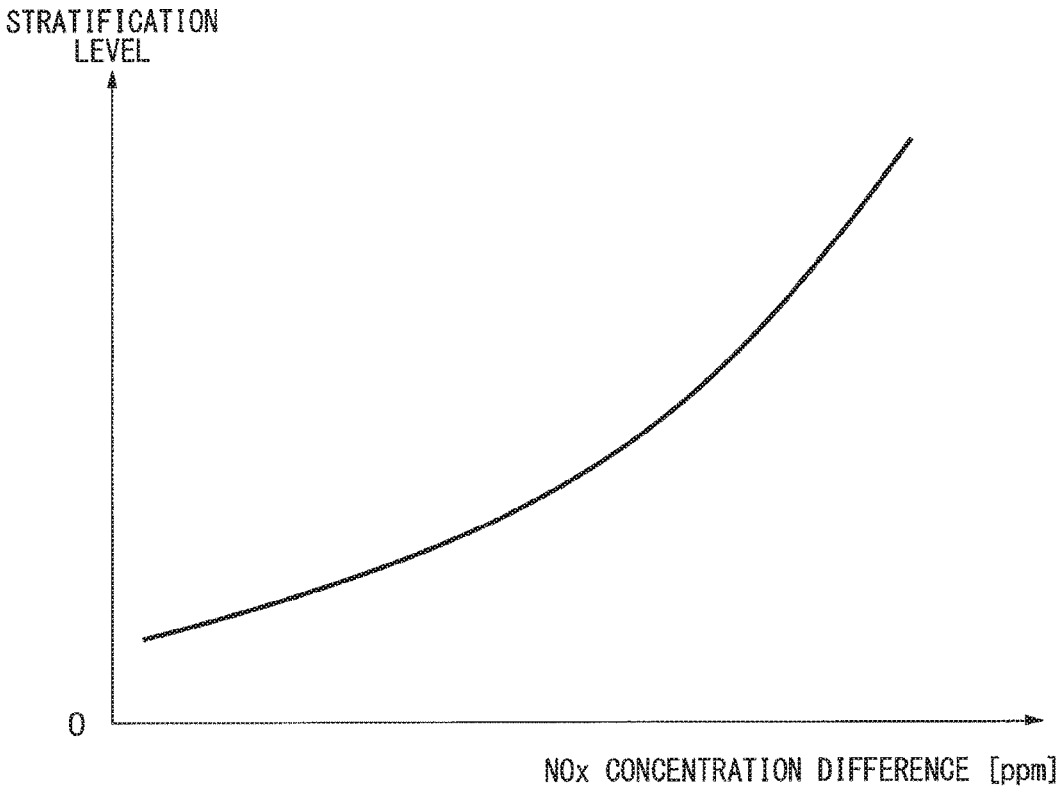
FIG. 7 is a graph showing a relation of a difference in concentration of nitrogen oxide in a combustion gas and a level of stratification of an air-fuel mixture.

As is shown in FIG. 6, the ECU 10 checks an air-fuel ratio of an air-fuel mixture in the combustion chamber 46 acquired during execution of the stratified charge combustion mode against a table. The table represents the matching data created in S14 described above. By checking the air-fuel ratio of the air-fuel mixture against the table, a concentration of nitrogen oxide in a combustion gas during execution of the homogeneous combustion mode at the acquired air-fuel ratio can be acquired. In other words, an air-fuel ratio of an air-fuel mixture acquired during execution of the stratified charge combustion mode is checked against the table to estimate a concentration of nitrogen oxide in a combustion gas under a condition that the homogenous combustion mode is executed at the acquired air-fuel ratio. The ECU 10 calculates a difference (a difference in NOx concentration) between a concentration of nitrogen oxide in a combustion gas during execution of the homogenous combustion mode and a concentration of nitrogen oxide in a combustion gas during execution of the stratified charge combustion mode.

The ECU 10 also acquires a correction coefficient by checking a temperature of the combustion gas in the cylinder 42 against another table. The ECU 10 calculates a correlation index by multiplying the difference in NOx concentration by the correction coefficient.

The ECU 10 is also capable of calculating a level of stratification of an air-fuel mixture in the combustion chamber 46 by checking the correlation index against still another table. As is shown in FIG. 7, the table checked against the correlation index has a difference in NOx concentration and a level of stratification. FIG. 7 reveals a tendency that a level of stratification of an air-fuel mixture in the combustion chamber 46 rises as a difference in NOx concentration becomes larger, that is, as a difference between a concentration of nitrogen oxide in a combustion gas during execution of the homogenous combustion mode and a concentration of nitrogen oxide in a combustion gas during execution of the stratified charge combustion mode becomes larger.

FIG. 5 is referred to again in the following. The ECU 10 adjusts fuel injection in S19 after a level of stratification is calculated in S18 of FIG. 5. That is, the ECU 10 adjusts an amount of fuel to be injected by the injector 27, injection timing, the number of injections, and a pressure according to the level of stratification calculated in S18.

Subsequently, the ECU 10 adjusts ignition of fuel in S20. That is, the ECU 10 adjusts ignition energy of the spark plug 28, ignition timing, the number of ignitions, and so on according to the level of stratification the ECU 10 has calculated in S18.

As has been described above, the ECU 10 of the present embodiment estimates a level of stratification according to not only an air-fuel ratio of an air-fuel mixture in the combustion chamber 46, but also a concentration of nitrogen oxide in a combustion gas exhausted from the engine 100. That is, given a circumstance that a concentration of nitrogen oxide in a combustion gas may possibly be increased as an outcome of the stratified charge combustion, the ECU 10 estimates a level of stratification also according to the concentration of nitrogen oxide in the combustion gas. Hence, according to the present disclosure, a level of stratification can be estimated with a high degree of accuracy.

The ECU 10 includes the pressure acquisition unit 13 which acquires an internal pressure of the combustion chamber 46, and the combustion gas temperature calculation unit 15 which calculates a temperature of a combustion gas according to an internal pressure of the combustion chamber 46. The stratification level estimation unit 16 estimates a level of stratification according to a temperature of a combustion gas calculated by the combustion gas temperature calculation unit 15. As has been described with reference to FIG. 4 above, a highest combustion gas temperature is one of the factors that give influences to a concentration of nitrogen oxide in a combustion gas. Hence, a level of stratification can be estimated with a higher degree of accuracy by removing influences of a highest combustion gas temperature in addition to influences of the other factors, namely, a concentration of intake $N_2$, a concentration of intake $O_2$, and an in-cylinder air-fuel ratio distribution, from a concentration of nitrogen oxide acquired by the nitrogen oxide concentration acquisition unit 12.

The ECU 10 also includes the stratification charge combustion mode execution unit 18 which executes the stratified charge combustion mode in which an air-fuel mixture is burned while a level of stratification is at or above the threshold, and the homogeneous combustion mode execution unit 19 which executes the homogeneous combustion mode in which an air-fuel mixture is burned while a level of stratification is below the threshold. The ECU 10 also includes the matching data creation unit 14 which creates matching data representing a relation of an air-fuel ratio acquired by the air-fuel ratio acquisition unit 11 and a concentration of nitrogen oxide acquired by the nitrogen oxide concentration acquisition unit 12 during execution of the homogeneous combustion mode and stores the matching data thus created into the storage unit 17. The stratification level estimation unit 16 estimates a level of stratification according to a difference between a concentration of nitrogen oxide acquired by checking an air-fuel ratio acquired by the air-fuel ratio acquisition unit 11 during execution of the stratified charge combustion mode against the matching data and a concentration of nitrogen oxide acquired by the nitrogen oxide concentration acquisition unit 12 during execution of the stratified charge combustion mode. Hence, the ECU 10 becomes capable of estimating a level of stratification with a higher degree of accuracy by creating the matching data during the homogenous combustion that can be triggered relatively easily in the combustion chamber 46 and by estimating a level of stratification using the matching data.

The stratified charge combustion mode execution unit 18 is enabled to execute the stratified charge combustion mode after the matching data creation unit 14 creates the matching data. That is, the stratified charge combustion mode is executed in a state where the matching data is created and therefore a level of stratification of an air-fuel mixture in the combustion chamber 46 can be estimated precisely. Hence, a level of stratification can be maintained at an appropriate value.

While the above has described one embodiment of the present disclosure by referring to specific examples, it should be appreciated that the present disclosure is not limited to the specific examples above. Anyone skilled in the art may add design modifications to the specific examples above as needed and modified specific examples are included in the scope of the present disclosure as long as the modified specific examples have characteristics of the present disclosure. Elements included in the respective specific examples above as well as locations, materials, conditions, shapes, and sizes of the elements are not limited to what have been described above as examples and can be modified as needed.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A control apparatus of an internal combustion engine having an injector which directly injects fuel into a combustion chamber of a cylinder, and a spark plug which ignites an air-fuel mixture containing the fuel injected by the injector, comprising:

an air-fuel ratio acquisition unit acquiring an air-fuel ratio of the air-fuel mixture in the combustion chamber;

a nitrogen oxide concentration acquisition unit acquiring a concentration of nitrogen oxide in a combustion gas exhausted from the internal combustion engine; and a stratification level estimation unit estimating a level of stratification as a measure of level of distribution of the air-fuel mixture at a predetermined air-fuel ratio or below in a vicinity of the spark plug, wherein the stratification level estimation unit estimates the level of stratification according to the air-fuel ratio acquired by the air-fuel ratio acquisition unit and the concentration of nitrogen oxide acquired by the nitrogen oxide concentration acquisition unit.

2. The control apparatus according to claim 1, further comprising:

a pressure acquisition unit acquiring an internal pressure of the combustion chamber; and a combustion gas temperature calculation unit calculating a temperature of the combustion gas according to the internal pressure of the combustion chamber, wherein the stratification level estimation unit estimates the level of stratification according to the temperature of the combustion gas calculated by the combustion gas temperature calculation unit.

3. The control apparatus according to claim 1, further comprising:

a stratified charge combustion mode execution unit executing a stratified charge combustion mode in which the air-fuel mixture is burned while the level of stratification is at or above a threshold;

a homogeneous combustion mode execution unit executing a homogenous combustion mode in which the air-fuel mixture is burned while the level of stratification is below the threshold; and a matching data creation unit creating matching data representing a relation of an air-fuel ratio acquired by the air-fuel ratio acquisition unit and a concentration of nitrogen oxide acquired by the nitrogen oxide concentration acquisition unit during execution of the homogeneous combustion mode, wherein the stratification level estimation unit estimates the level of stratification according to a difference between a concentration of nitrogen oxide acquired by checking an air-fuel ratio acquired by the air-fuel ratio acquisition unit during execution of the stratified charge combustion mode against the matching data and a concentration of nitrogen oxide acquired by the nitrogen oxide concentration acquisition unit during execution of the stratified charge combustion mode.

4. The control apparatus according to claim 3, wherein:

the stratified charge combustion mode execution unit is enabled to execute the stratified charge combustion mode after the matching data creation unit creates the matching data.

* * * * *